US009138857B2

(12) United States Patent
Lu et al.

(10) Patent No.: US 9,138,857 B2
(45) Date of Patent: Sep. 22, 2015

(54) CHEMICAL MECHANICAL POLISHING MACHINE AND CHEMICAL MECHANICAL POLISHING APPARATUS COMPRISING THE SAME

(75) Inventors: Xinchun Lu, Beijing (CN); Zhenjie Xu, Beijing (CN); Yongyong He, Beijing (CN); Tongqing Wang, Beijing (CN); Pan Shen, Beijing (CN); Dewen Zhao, Beijing (CN); Hegeng Mei, Beijing (CN); Lianqing Zhang, Beijing (CN); Zhaohui Pei, Beijing (CN); Jianbin Luo, Beijing (CN)

(73) Assignee: HWATSING TECHNOLOGY CO., LTD., Jinnan District, Tainjin (CN)

( * ) Notice: Subject to any disclaimer, the term of this patent is extended or adjusted under 35 U.S.C. 154(b) by 120 days.

(21) Appl. No.: 13/384,627

(22) PCT Filed: Jun. 8, 2011

(86) PCT No.: PCT/CN2011/075452

§ 371 (c)(1),
(2), (4) Date: Jan. 18, 2012

(87) PCT Pub. No.: WO2012/016477

PCT Pub. Date: Feb. 9, 2012

(65) Prior Publication Data

US 2013/0130601 A1 May 23, 2013

(30) Foreign Application Priority Data

Aug. 5, 2010 (CN) ..... 2010 1 0246628
Aug. 5, 2010 (CN) ..... 2010 2 0283455

(51) Int. Cl.
*B24B 37/04* (2012.01)
*B24B 37/10* (2012.01)

(52) U.S. Cl.
CPC ..... *B24B 37/04* (2013.01); *B24B 37/10* (2013.01)

(58) Field of Classification Search
CPC ..... B24B 37/04; B24B 37/10; B24B 37/105; B24B 37/107; B24B 37/30; B24B 37/34
USPC ..... 451/41, 63, 285–290
See application file for complete search history.

(56) References Cited

U.S. PATENT DOCUMENTS 3,342,652 A * 9/1967 Reisman et al. ..... 438/692
6,162,112 A * 12/2000 Miyazaki et al. ..... 451/36

(Continued)

FOREIGN PATENT DOCUMENTS

CN 1817564 A 8/2006
CN 1867424 A 11/2006

(Continued)

OTHER PUBLICATIONS

Sep. 1, 2011 International Search Report for PCT/CN2011/075452.

(Continued)

*Primary Examiner* — Monica Carter
*Assistant Examiner* — Marcel Dion
(74) *Attorney, Agent, or Firm* — Howard & Howard Attorneys PLLC

(57) ABSTRACT

A chemical-mechanical polishing machine includes a work table, polishing platen mounted onto the work table, pad conditioner and slurry-delivery device mounted on the work table and disposed near the polishing platen, and polishing-head support mounted on the work table and including a base plate and supporting side plates. The base plate is formed with a groove in a "thickness" direction. A loading and unloading table is mounted on the work table, disposed below the base plate, and opposed to the polishing platen. A polishing head is rotatably disposed on the polishing-head support, movable in the longitudinal direction, and passes through the groove to extend downwardly. A robotic manipulator is disposed near the work table for placing a wafer on the loading and unloading table and taking the wafer away from it. A chemical-mechanical polishing apparatus includes an array of a plurality of the machine.

14 Claims, 3 Drawing Sheets

(56) References Cited

U.S. PATENT DOCUMENTS

| | | | | |
|---|---|---|---|---|
| 7,540,799 | B1 * | 6/2009 | Trojan | 451/8 |
| 2001/0005665 | A1 * | 6/2001 | Hempel et al. | 451/41 |
| 2002/0033230 | A1 * | 3/2002 | Hayashi et al. | 156/345 |
| 2003/0045107 | A1 * | 3/2003 | Jeong | 438/692 |
| 2003/0236056 | A1 | 12/2003 | Boo et al. | |
| 2005/0014456 | A1 * | 1/2005 | Hoshino | 451/41 |
| 2005/0048880 | A1 * | 3/2005 | Tolles et al. | 451/66 |
| 2007/0060023 | A1 * | 3/2007 | Jeong | 451/5 |
| 2008/0051014 | A1 * | 2/2008 | Jeong et al. | 451/61 |
| 2009/0209176 | A1 * | 8/2009 | Katsuoka et al. | 451/8 |
| 2009/0258574 | A1 * | 10/2009 | Yilmaz et al. | 451/28 |
| 2009/0270015 | A1 * | 10/2009 | D'Ambra et al. | 451/28 |

FOREIGN PATENT DOCUMENTS

| | | | |
|---|---|---|---|
| CN | 101704218 | A | 5/2010 |
| CN | 101740450 | A | 6/2010 |
| CN | 101934496 | A | 1/2011 |
| CN | 102049730 | A | 5/2011 |
| CN | 201833275 | U | 5/2011 |
| JP | 200371709 | A | 3/2003 |
| TW | 200946280 | A1 | 11/2009 |
| WO | 2006112532 | A1 | 10/2006 |

OTHER PUBLICATIONS

Sep. 15, 2011 International Search Report for PCT/CN2011/076831.

* cited by examiner

CHEMICAL MECHANICAL POLISHING MACHINE AND CHEMICAL MECHANICAL POLISHING APPARATUS COMPRISING THE SAME

CROSS-REFERENCE TO RELATED APPLICATIONS

This is "national phase" application of Patent Cooperation Treaty Application PCT/CN2011/075452 filed on Jun. 8, 2011, which, in turn, claims priority to and benefit of the filing date of Chinese Patent Applications 201010246628.1 and 201020283455.6 filed on Aug. 5, 2010 and entitled "Chemical Mechanical Polishing Machine and Chemical Mechanical Polishing Apparatus Comprising the Same."

BACKGROUND OF INVENTION

1. Field of Invention

The invention relates, generally, to a chemical-mechanical polishing machine and, more specifically, to a chemical-mechanical polishing apparatus that includes an array of a plurality of the machine.

2. Description of Related Art

During large-scale integrated-circuit manufacturing, the planarization process of the deposition layer on a wafer is necessary and complex. Currently, the planarization process is performed by a chemical-mechanical polishing (CMP), and the chemical-mechanical polishing machine is a main apparatus for performing the chemical-mechanical polishing.

A conventional chemical-mechanical polishing machine includes generally a work table on which three polishing platens, a loading and unloading table, four polishing heads, and a cross-polishing-head support are mounted. Four cantilevers of the cross-polishing-head support absorb a polishing head, respectively, and two adjacent cantilevers are perpendicular to each other. A wafer absorbed by one polishing head should be polished on the three platens in sequence while a wafer to be polished absorbed by the polishing head located above the loading and unloading table waits for polishing. When the polishing of one of the wafers is finished, the polishing-head support rotates by 90 degrees so that the polishing head carrying the polished wafer rotates above the loading and unloading table and each of the other three polishing heads carrying wafers rotate above a next polishing platen, respectively, and, thus, perform the next polishing process for each of the wafers carried by the other three polishing heads. Each polishing head of the conventional chemical-mechanical polishing machine needs to move from a position above the polishing platen to another position above the loading and unloading table. During loading and unloading of the wafer, the center of one polishing head should be aligned with the center of the loading and unloading table, and the centers of the other three polishing heads for performing polishing should be aligned with the centers of the three polishing platens, respectively.

Therefore, high control accuracy is required. Moreover, the cross-polishing-head support of the conventional polishing machine is heavy in weight, complicated in structure, difficult in manufacturing, high in cost, and requires high precision. In addition, the four polishing heads on the cantilevers disadvantageously affect one another. For example, if there is something wrong with one of the polishing heads or the wafer carried thereby, the machine has to stop operation, thus decreasing the efficiency. The cantilevers of the cross-polishing-head support may magnify a "'rotation' position" error of the polishing-head support so that the polishing-head support is required to control with high precision for loading and unloading the wafer. In addition, the rotation error of the polishing-head support varies each time so that an adjusting of the polishing head position becomes more difficult.

Thus, there is a need in the related art for a chemical-mechanical polishing machine that solves at least one of these technical problems. More specifically, there is a need in the related art for such a machine that is simple in structure, easy to manufacture, and high in manufacturing efficiency and the requirement for control accuracy of which is low. There is a need in the related art also for a chemical-mechanical polishing apparatus that includes an array of a plurality of the machine.

SUMMARY OF INVENTION

The invention overcomes the disadvantages in the related art in a chemical-mechanical polishing machine. The machine includes a work table, a polishing platen mounted onto an upper surface of the work table, and a pad conditioner and slurry-delivery device that are mounted on the upper surface of the work table and disposed near the polishing platen. A polishing-head support is mounted on the upper surface of the work table and includes a substantially horizontal base plate and plurality of supporting side plates. The horizontal base plate is formed with a groove penetrating through the horizontal base plate in a substantially "thickness" direction of the horizontal base plate. The groove is open at a first longitudinal end of the horizontal base plate and extends toward a second longitudinal end of the horizontal base plate. The supporting side plates are connected to the horizontal base plate and disposed at corresponding sides of the groove in a substantially transverse direction of the horizontal base plate for supporting the horizontal base plate. The first longitudinal end of the horizontal base plate is extended beyond the supporting side plates in a substantially longitudinal direction of the horizontal base plate to form a cantilever end and extended above the polishing platen. A loading and unloading table is mounted on the work table, disposed below the horizontal base plate, and opposed to the polishing platen. A substantially longitudinal central axis of the groove in the polishing-head support is run through at least one center of the polishing platen, and the loading and unloading table is disposed in a substantially longitudinal centerline of the groove. A polishing head is rotatably disposed on the polishing-head support, movable in the longitudinal direction, and passes through the groove to extend downwardly. A robotic manipulator is disposed substantially near the work table for placing a wafer on the loading and unloading table and taking the wafer away from the loading and unloading table. The invention overcomes the disadvantages in the related art also in a chemical-mechanical polishing apparatus that includes an array of a plurality of the machine.

An advantage of the chemical-mechanical polishing machine of the invention is that it is simple in structure.

Another advantage of the chemical-mechanical polishing machine of the invention is that it is easy to manufacture.

Another advantage of the chemical-mechanical polishing machine of the invention is that it is high in manufacturing efficiency.

Another advantage of the chemical-mechanical polishing machine of the invention is that the requirement for control accuracy of it is low.

Another advantage of the chemical-mechanical polishing machine of the invention is that a chemical-mechanical polishing apparatus includes an array of a plurality of the machine.

Other objects, features, and advantages of the invention are readily appreciated as the same becomes better understood while the subsequent detailed description of embodiments of the invention is read taken in conjunction with the accompanying drawing thereof.

BRIEF DESCRIPTION OF EACH FIGURE OF DRAWING OF INVENTION

DETAILED DESCRIPTION OF EMBODIMENTS OF INVENTION

Figure 1:
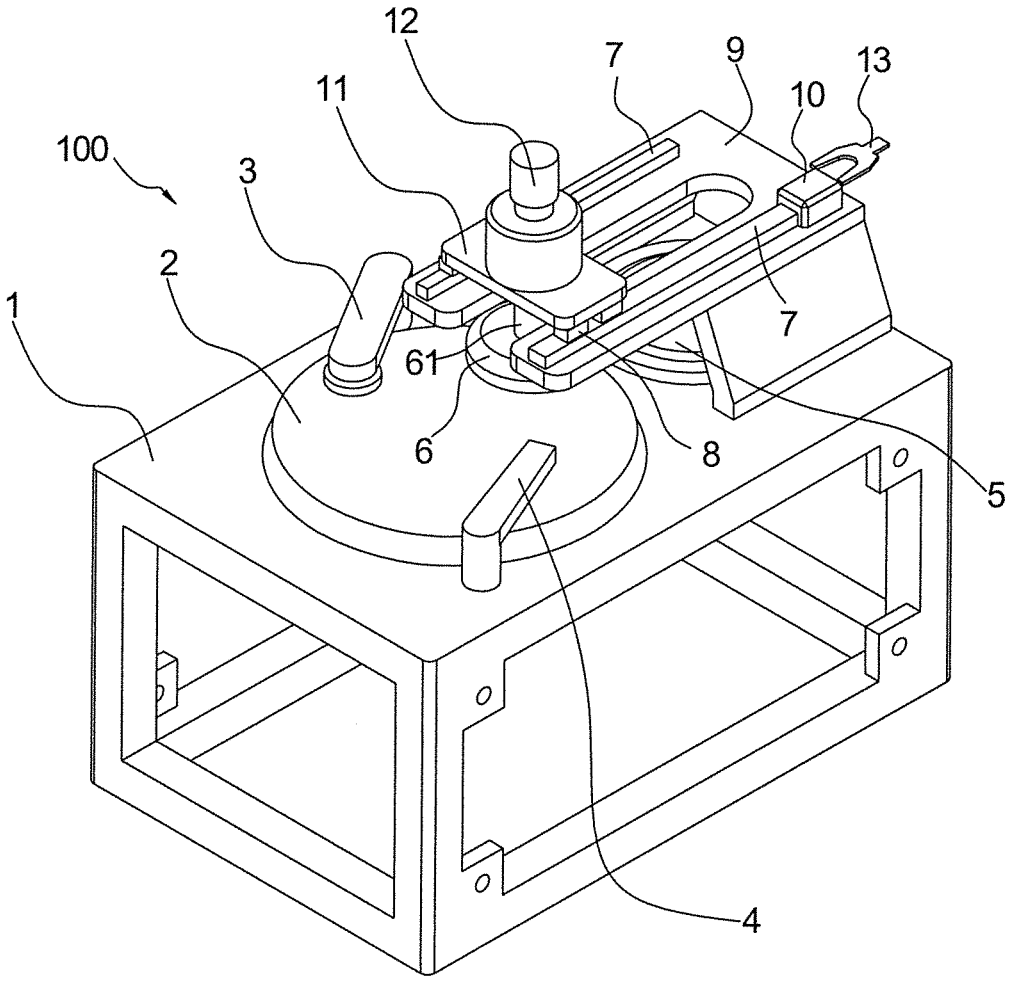
FIG. 1 is a perspective view of an embodiment of a chemical-mechanical polishing machine according to the invention.

Referring now to the figures, where like numerals are used to represent like structure, an embodiment of a chemical-mechanical polishing machine according to the invention is generally indicated at 100. As shown in FIG. 1, the chemical-mechanical polishing machine 100 includes generally a work table 1, polishing platen 2, pad conditioner 3, slurry-delivery device 4, loading and unloading table 5, polishing head 6, polishing-head support 9, and robotic manipulator 13.

Figure 2:
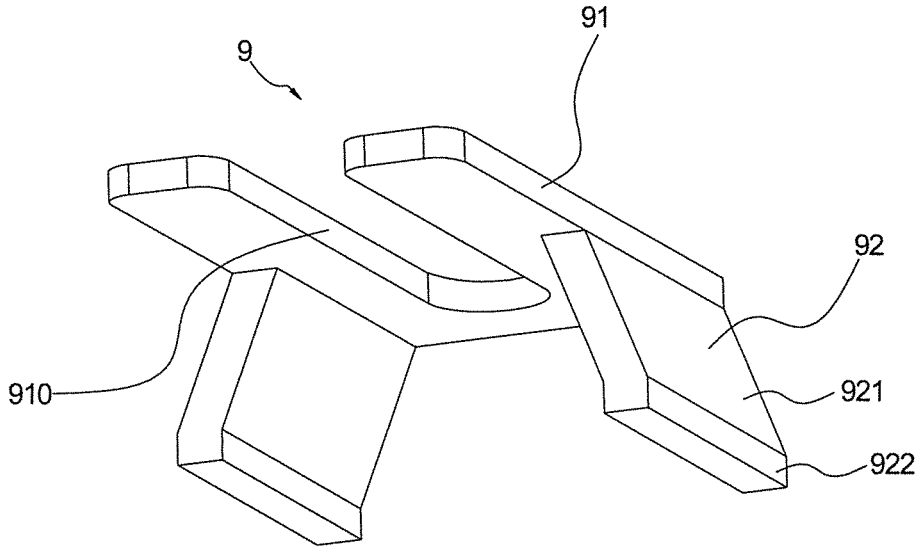
FIG. 2 is a perspective view of a polishing-head support of a "diving platform" type of the embodiment of the chemical-mechanical polishing machine according to the invention shown in FIG. 1.

In an embodiment, as shown in FIGS. 1 and 2, the polishing-head support 9 includes a horizontal base plate 91 and two supporting side plates 92. A groove 910 is formed in the horizontal base plate 91. The groove 910 penetrates through the horizontal base plate 91 along the "thickness" direction of the horizontal base plate 91. The groove 910 is open at one longitudinal end of the horizontal base plate 91 and extends toward the other longitudinal end of the horizontal base plate 91. In other words, one end of the groove 910 is open while the other end is closed.

The two supporting side plates 92 are connected with the horizontal base plate 91. In an embodiment, respective upper ends of the supporting side plates 92 are connected with a bottom of the horizontal base plate 91. The two supporting side plates 92 are respectively positioned at two sides of the groove 910 in a transverse direction of the horizontal base plate 91. The one longitudinal end (the left end as viewed in FIG. 2) of the horizontal base plate 91 is extended beyond the left end of the supporting side plates 92 so that the left end of the horizontal base plate 91 is formed as a cantilever end. The other longitudinal end (the right end as viewed in FIG. 2) of the horizontal base plate 91 may be extended beyond or flush with the right end of the supporting side plates 92. The polishing-head support is similar to a diving platform so that it may be referred as a "'diving platform' type polishing-head support." The top and bottom surfaces of the supporting side plates 92 are located on a same horizontal plane so that the horizontal base plate 91 is ensured to be horizontal when the supporting side plates 92 are mounted onto the work table 1 of the chemical-mechanical polishing machine 100.

The polishing-head support 9 is simple in structure and easy to manufacture. Moreover, requirements of a polishing machine employing the polishing-head support 9 for control accuracy are low, and the polishing efficiency is improved.

In an embodiment, the horizontal base plate 91 is U-shaped, and the closed end of the groove 910 is arched. The supporting side plate 92 includes an upper plate portion 921 and lower plate portion 922 connected to a lower end of the upper plate portion 921. The upper plate portions 921 of the two supporting side plates 92 are inclined outwardly and downwardly from the bottoms of the horizontal base plate 91, and the lower plate portions 922 are vertically extended downwardly from the lower ends of the upper plate portions 921, respectively. The lower plate portion 922 and upper plate portion 921 may be formed integrally. Alternatively, the lower plate portion 922 may be formed separately and then connected to the upper plate portion 921 via welding or bolt connection.

In an embodiment, the supporting side plates 92 may be mounted onto the bottom of the horizontal base plate 91 via welding or bolt connection. Alternatively, the supporting side plate 92 may also be mounted onto two sides of the horizontal base plate 91 in the transverse direction via welding or bolt connection.

The polishing-head support 9 requires high rigidity and good antiseptic property. In an embodiment, the polishing-head support 9 may be formed by stainless steel or other materials with high hardness and then coated with an antiseptic coating layer. Considering manufacturing and material, the polishing-head support 9 is, in an embodiment, formed by the stainless steel.

In an example, the work table 1 may be a generally rectangular frame. The polishing platen 2 is mounted at a left side of the upper surface of the work table 1, and the loading and unloading table 5 is mounted at a right side of the upper surface of the work table 1 and opposite to the polishing platen 2. The pad conditioner 3 and slurry-delivery device 4 are mounted at a suitable position near the polishing platen 2. Free ends of the pad conditioner 3 and slurry-delivery device 4 are extended above the polishing platen 2. The pad conditioner 3 is used to condition a wafer, and the slurry-delivery device 4 is used to deliver the slurry onto the upper polishing platen 2.

The polishing-head support 9 is mounted onto the work table 1, and the cantilever end of the horizontal base plate 91 of the polishing-head support 9 is extended above the polishing platen 2. The loading and unloading table 5 is mounted onto the upper surface of the work table 1 and located below the polishing-head support 9 between the two supporting side plates 92. In an embodiment, centers of the polishing platen 2 and loading and unloading table 5 are located on a longitudinal centerline of the groove 910 in the horizontal base plate 91.

Two parallel guide rails 7 are disposed along both lateral sides of the groove 910 on the upper surface of the polishing-head support 9. The polishing head 6 is supported on the guide rails 7 via a carrier 11. In an embodiment, a slide block 8 is disposed below the carrier 11 and may be movably supported on the guide rails 7. A driving motor 12 is disposed on the carrier 11. An output shaft of the driving motor 12 may be coupled with the polishing head 6 below the carrier 11 via a reducer for driving the polishing head 6 to rotate.

The carrier 11 is driven by a servomotor 10 along the guide rails 7 to reciprocate in the longitudinal direction. In an embodiment, the carrier 11 may be driven by the servomotor 10 via a leading screw. Alternatively, the servomotor 10 may be replaced by a hydraulic cylinder driving the carrier 11 hydraulically. A vertical shaft 61 connecting the polishing head 6 to the reducer is moved inside the groove 910. Therefore, the polishing head 6 may move above the polishing platen 2 and the loading and unloading table 5, respectively.

The robotic manipulator 13 is disposed near the work table 1 for placing a wafer onto the loading and unloading table 5 and taking the wafer away from the loading and unloading table 5. The structure and control of the robotic manipulator 13 is well-known to those having ordinary skill in the related art such that detailed descriptions thereof are omitted here.

In operation of the machine 100, the wafer to be polished is placed onto the loading and unloading table 5 by the robotic manipulator 13. Then, the servomotor 10 drives the polishing head 6 to move above the loading and unloading table 5, and the loading and unloading table 5 rises so that the wafer to be polished is absorbed by the polishing head 6. Next, the servomotor 10 drives the polishing head 6 to move above the polishing platen 2, and then the polishing head 6 is rotated by the driving motor 12. In the meantime, the polishing head 6 is driven to reciprocate in the longitudinal direction by the servomotor 10 to polish the wafer. The reciprocating stroke of the polishing head 6 has two "limitation" positions: one "limitation" position is a position at which the periphery of the wafer carried by the polishing head 6 fitly reaches the center of the polishing platen 2, and the other "limitation" position is a position at which the periphery of the wafer carried by the polishing head fitly reaches the periphery of the polishing platen 2.

Then, the polishing of the wafer is finished, and the polishing head 6 carrying the wafer translates from a position above the polishing platen 2 to another position above the loading and unloading table 5. The translation stroke of the polishing head 6 has two "limiting" positions: one is a position at which the periphery of the wafer carried by the polishing head fitly reaches the periphery of polishing platen 2, and the other is a position at which the center of the polishing head 6 is fitly aligned with the center of the loading and unloading table 5. The polishing head 6 reciprocates and translates on the guide rails 7 by the driving of the servomotor 10. It can be understood that a length of a straight portion of the U-shaped groove as well as a length of the guide rails 7 should be larger than a sum of the reciprocating stroke and translation stroke of the polishing head 6.

The loading and unloading table 5 rises after the center of the polishing head 6 is aligned with that of the loading and unloading table 5. The polished wafer is unloaded onto the loading and unloading table 5. The loading and unloading table 5 descends, and the robotic manipulator 13 translates above the loading and unloading table 5 to seize the polished wafer and convey it to a predetermined position.

Then, the robotic manipulator 13 carrying a wafer to be polished is translated above the loading and unloading table 5 and places the wafer onto the loading and unloading table 5. The loading and unloading table 5 rises, and the wafer is absorbed by the polishing head 6, thus finishing the loading of the wafer to be polished. Next, the polishing head 6 translates above the polishing platen 2, longitudinally reciprocates by the driving of the servomotor 10, and rotates by the driving of the driving motor 12 simultaneously to polish the wafer.

Since the polishing head 6 is supported on the "diving platform" type polishing-head support 9 and moved along the guide rails 7 mounted onto the polishing-head support 9, the chemical-mechanical polishing machine 100 may be referred to as a "chemical-mechanical polishing machine of 'diving platform' type."

Figure 3:
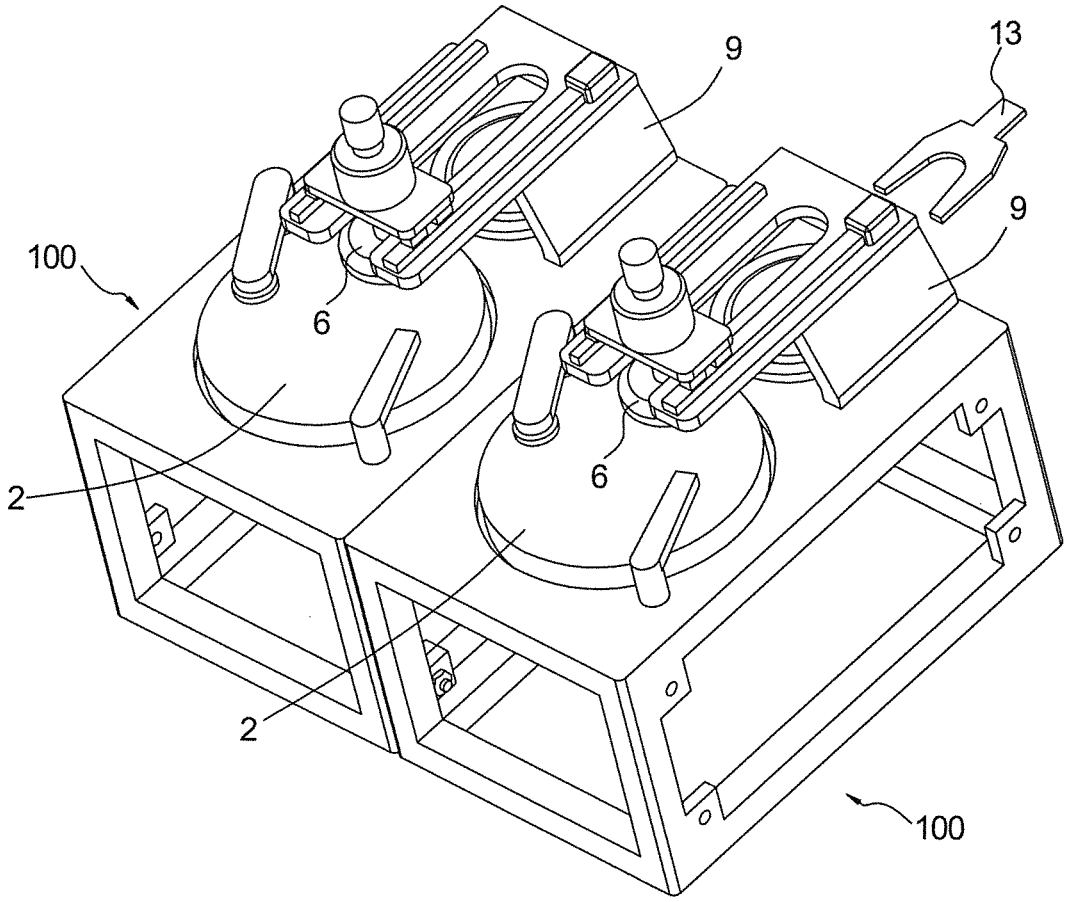
FIG. 3 is a perspective view of an embodiment of a chemical-mechanical polishing apparatus according to the invention.

Referring to FIG. 3, in an embodiment, a chemical-mechanical polishing apparatus includes two chemical-mechanical polishing machines 100 disposed side-by-side and close to each other, and the two chemical-mechanical polishing machines 100 share one robotic manipulator 13. Alternatively, the two chemical-mechanical polishing machines 100 may further share one work table 1 to reduce a component quantity of the chemical-mechanical polishing apparatus and decrease the cost. The chemical-mechanical polishing machines 100 operate independently without interference with each other, thus improving work efficiency.

Figure 4:
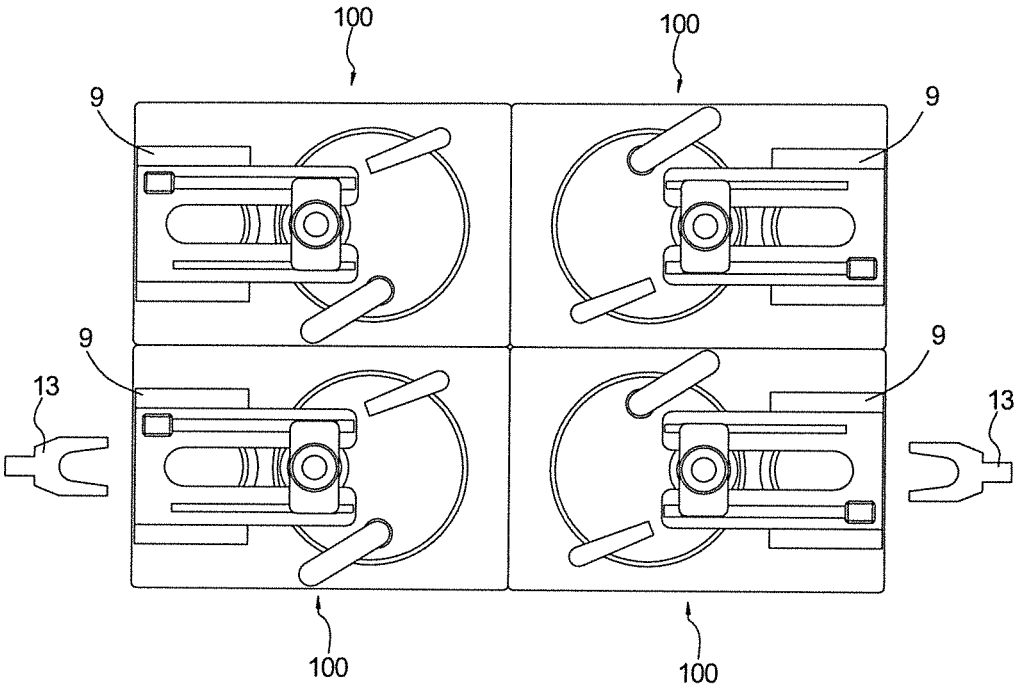
FIG. 4 is a plan view of another embodiment of the chemical-mechanical polishing apparatus according to the invention.

Referring to FIG. 4, in an embodiment, a chemical-mechanical polishing apparatus includes four chemical-mechanical polishing machines 100 arranged in two rows that are close to each other. The two rows of the chemical-mechanical polishing machines 100 are disposed back-to-back, and two robotic manipulators 13 are employed such that two chemical-mechanical polishing machines 100 in the same row share one robotic manipulator 13. The four chemical-mechanical polishing machines 100 may share one work table 1.

Figure 5:
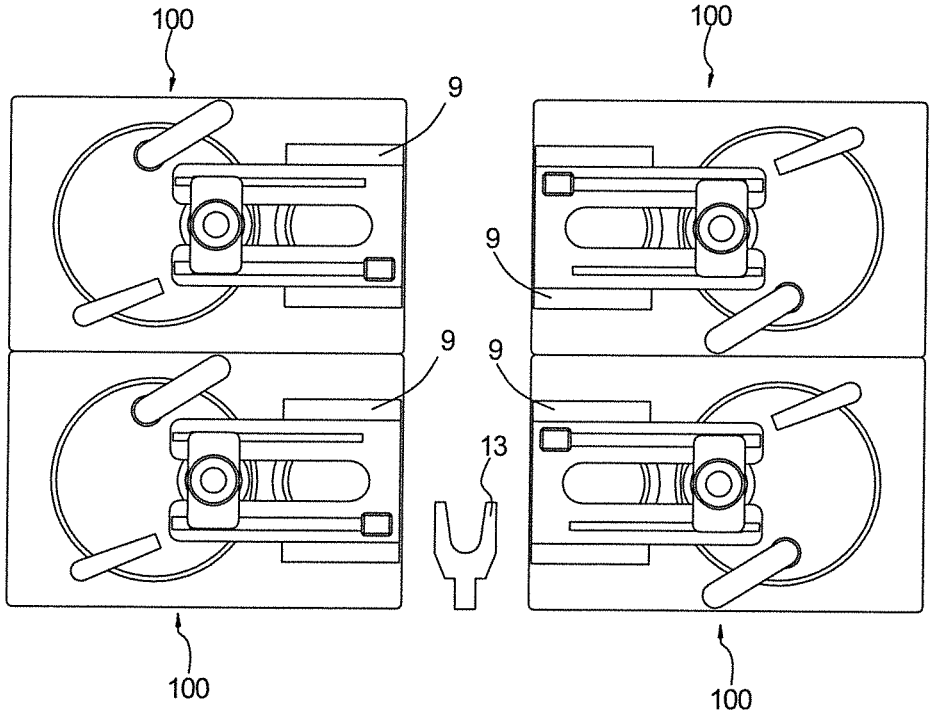
FIG. 5 is a plan view of another embodiment of the chemical-mechanical polishing apparatus according to the invention.

Referring to FIG. 5, in an embodiment, a chemical-mechanical polishing apparatus includes four chemical-mechanical polishing machines 100 arranged in two rows spaced by a predetermined interval—that is, the two rows of the chemical-mechanical polishing machines 100 are disposed face-to-face. The four chemical-mechanical polishing machines 100 may share one robotic manipulator 13. The two chemical-mechanical polishing machines 100 in the same row may share one work table 1.

In the embodiments shown in FIGS. 4 and 5, the four chemical-mechanical polishing machines 100 operate independently without interference with each other, thus improving work efficiency. Moreover, the component quantity is reduced, and the control is simplified.

The machine 100 is simple in structure, easy to manufacture, and high in manufacturing efficiency. Also, the requirement for control accuracy of the machine 100 is low. Furthermore, the apparatus includes an array of a plurality of the machine 100.

The invention has been described above in an illustrative manner. It is to be understood that the terminology that has been used above is intended to be in the nature of words of description rather than of limitation. Many modifications and variations of the invention are possible in light of the above teachings. Therefore, within the scope of the appended claims, the invention may be practiced other than as specifically described above.

What is claimed is:

1. A chemical-mechanical polishing machine comprising:

a work table;

a polishing platen mounted onto an upper surface of said work table;

a pad conditioner and slurry-delivery device that are mounted on said upper surface of said work table and disposed near said polishing platen;

a polishing-head support mounted on said upper surface of said work table and including a substantially horizontal base plate and plurality of supporting side plates disposed on the work table, said horizontal base plate being formed with a groove penetrating therethrough in a substantially "thickness" direction thereof, said groove being open at a first longitudinal end of said horizontal base plate and extending toward a second longitudinal end of said horizontal base plate, said supporting side plates being connected to said horizontal base plate and disposed at corresponding sides of said groove in a substantially transverse direction of said horizontal base plate for supporting said horizontal base plate on the work table, and said first longitudinal end of said horizontal base plate being extended beyond said supporting side plates in a substantially longitudinal direction of said horizontal base plate to form a cantilever end and extended above said polishing platen;

a loading and unloading table mounted on said work table, disposed below said horizontal base plate, and opposed to said polishing platen, a substantially longitudinal central axis of said groove in said polishing-head support being run through at least one center of said polishing platen and said loading and unloading table being disposed in a substantially longitudinal centerline of said groove;

a polishing head rotatably disposed on said polishing-head support, movable in said longitudinal direction, and passing through said groove to extend downwardly; and a robotic manipulator disposed substantially near said work table for placing a wafer on said loading and unloading table and taking said wafer away from said loading and unloading table wherein each of said supporting side plates includes an upper plate portion and lower plate portion connected to a lower end of said upper plate portion and extended substantially vertically and downwardly from said lower end of said upper plate portion, said upper plate portion is inclined outwardly and downwardly from a bottom of said horizontal base plate, and said upper and lower plate portions are either of integrally formed and connected by either of welding and bolt connection.

2. A chemical-mechanical polishing machine as set forth in claim 1, wherein guide rails are disposed on an upper surface of said polishing-head support at respective sides of said groove in said transverse direction and said polishing head is movably disposed on said guide rails via a carrier.

3. A chemical-mechanical polishing machine as set forth in claim 2, wherein slide blocks are disposed on a lower surface of said carrier at respective sides of said carrier in said transverse direction and said carrier is disposed on said guide rails via said slide blocks.

4. A chemical-mechanical polishing machine as set forth in claim 2, wherein a driving motor for driving said polishing head to rotate is disposed on said carrier.

5. A chemical-mechanical polishing machine as set forth in claim 1, wherein either of a hydraulic cylinder and servomotor for driving said polishing head to move in said longitudinal direction is disposed on said polishing-head support.

6. A chemical-mechanical polishing machine as set forth in claim 1, wherein said horizontal base plate has a substantial U-shape and said supporting side plates are mounted to said horizontal base plate through either of welding and bolt connection.

7. A chemical-mechanical polishing apparatus comprising:

an array of a plurality of chemical-mechanical polishing machines each of which includes:

a work table;

a polishing platen mounted onto an upper surface of said work table;

a pad conditioner and slurry-delivery device that are mounted on said upper surface of said work table and disposed near said polishing platen;

a polishing-head support mounted on said upper surface of said work table and having a substantially horizontal base plate and plurality of supporting side plates disposed on the work table, said horizontal base plate being formed with a groove penetrating therethrough in a substantially "thickness" direction thereof, said groove being open at a first longitudinal end of said horizontal base plate and extending toward a second longitudinal end of said horizontal base plate, said supporting side plates being connected to said horizontal base plate and disposed at corresponding sides of said groove in a substantially transverse direction of said horizontal base plate for supporting said horizontal base plate on the work table, and said first longitudinal end of said horizontal base plate being extended beyond said supporting side plates in a substantially longitudinal direction of said horizontal base plate to form a cantilever end and extended above said polishing platen;

a loading and unloading table mounted on said work table, disposed below said horizontal base plate, and opposed to said polishing platen, a substantially longitudinal central axis of said groove in said polishing-head support being run through at least one center of said polishing platen and said loading and unloading table being disposed in a substantially longitudinal centerline of said groove;

a polishing head rotatably disposed on said polishing-head support, movable in said longitudinal direction, and passing through said groove to extend downwardly; and a robotic manipulator disposed substantially near said work table for placing a wafer on said loading and unloading table and taking said wafer away from said loading and unloading table wherein each of said supporting side plates includes an upper plate portion and lower plate portion connected to a lower end of said upper plate portion and extended substantially vertically and downwardly from said lower end of said upper plate portion, said upper plate portion is inclined outwardly and downwardly from a bottom of said horizontal base plate, and said upper and lower plate portions are either of integrally formed and connected by either of welding and bolt connection.

8. A chemical-mechanical polishing apparatus as set forth in claim 7, wherein guide rails are disposed on an upper surface of said polishing-head support at respective sides of said groove in said transverse direction and said polishing head is movably disposed on said guide rails via a carrier.

9. A chemical-mechanical polishing apparatus as set forth in claim 8, wherein slide blocks are disposed on a lower surface of said carrier at respective sides of said carrier in said transverse direction and said carrier is disposed on said guide rails via said slide blocks.

10. A chemical-mechanical polishing apparatus as set forth in claim 8, wherein a driving motor for driving said polishing head to rotate is disposed on said carrier.

11. A chemical-mechanical polishing apparatus as set forth in claim 7, wherein either of a hydraulic cylinder and servomotor for driving said polishing head to move in said longitudinal direction is disposed on said polishing-head support.

12. A chemical-mechanical polishing apparatus as set forth in claim 7, wherein said horizontal base plate has a substantial U-shape and said supporting side plates are mounted to said horizontal base plate through either of welding and bolt connection.

13. A chemical-mechanical polishing apparatus as set forth in claim 7, wherein said machines include a robotic manipulator and work table.

14. A chemical-mechanical polishing apparatus as set forth in claim 7, wherein said machines are arranged in a plurality of rows and two adjacent rows are disposed either of back-to-back and face-to-face.

* * * * *